US011027809B2

(12) United States Patent
Brouzes et al.

(10) Patent No.: US 11,027,809 B2
(45) Date of Patent: Jun. 8, 2021

(54) SAILING VESSEL

(71) Applicants: Paul Brouzes, Castries (FR); Frederic Brouzes, Castries (FR)

(72) Inventors: Paul Brouzes, Castries (FR); Frederic Brouzes, Castries (FR)

( * ) Notice: Subject to any disclaimer, the term of this patent is extended or adjusted under 35 U.S.C. 154(b) by 0 days.

(21) Appl. No.: 16/713,592

(22) Filed: Dec. 13, 2019

(65) Prior Publication Data

US 2020/0262533 A1 Aug. 20, 2020

(30) Foreign Application Priority Data

Feb. 16, 2019 (FR) ..... 1901592

(51) Int. Cl.

| | |
|---|---|
| ***B63H 9/04*** | (2020.01) |
| ***B63H 9/10*** | (2006.01) |
| ***B63H 9/069*** | (2020.01) |
| ***B63B 1/10*** | (2006.01) |
| ***B63B 1/12*** | (2006.01) |
| ***B63B 1/28*** | (2006.01) |

(Continued)

(52) U.S. Cl.

CPC ..... *B63H 9/10* (2013.01); *B63B 1/105* (2013.01); *B63B 1/125* (2013.01); *B63B 1/283* (2013.01); *B63H 9/069* (2020.02); *B63H 9/072* (2020.02); *B63H 25/38* (2013.01)

(58) Field of Classification Search

CPC ..... B63H 25/00; B63H 25/06; B63H 25/38; B63H 25/381; B63H 25/387; B63H 9/00; B63H 9/04; B63H 9/06; B63H 9/0685; B63H 9/069; B63H 9/0672; B63H 2009/0692; B63H 9/08; B63H 9/088; B63H 9/10; B63B 1/18; B63B 2001/183; B63B 1/20; B63B 1/204; B63B 1/205; B63B 1/207; B63B 1/208; B63B 1/24; B63B 1/242; B63B 1/26; B63B 1/28; B63B 1/283; B63B 1/32; B63B 1/322; B63B 2001/325; B63B 1/34; B63B 1/40

USPC ..... 114/102.1, 102.12, 102.13, 102.15, 114/102.16, 102.17, 102.18, 102.19, 114/102.2, 102.21, 102.22, 102.29, 108, 114/109, 111, 39.21, 39.24, 39.25, 39.26, 114/39.27, 39.29, 39.32, 56.1, 61.1, 114/61.12, 61.14, 61.2, 144 R, 152, 154, 114/155, 162

See application file for complete search history.

(56) References Cited

U.S. PATENT DOCUMENTS 3,112,725 A * 12/1963 Malrose ..... B63B 1/12 114/39.28
3,802,366 A * 4/1974 Mankawich ..... B63H 9/061 114/39.24

(Continued)

FOREIGN PATENT DOCUMENTS

FR 2 978 106 B1 8/2013

*Primary Examiner* — Daniel V Venne
(74) *Attorney, Agent, or Firm* — Cooley LLP

(57) ABSTRACT

Embodiments described herein relate generally to a sailing vessel that can substantially obviate the heeling problem experienced by classical sailboats. During navigation, the sailing vessel is driven forward by an aerodynamic force exerted by wind on the sail, and balanced by a hydrodynamic force exerted by water on a float on the stern of the sailing vessel, the aerodynamic force and the hydrodynamic force being parallel or substantially parallel to a longitudinal axis of the sailing vessel.

20 Claims, 12 Drawing Sheets

(51) Int. Cl.
*B63H 9/072* (2020.01)
*B63H 25/38* (2006.01)

(56) References Cited

U.S. PATENT DOCUMENTS 3,839,979 A * 10/1974 Wassell ..... B63B 7/02
114/39.28
4,524,709 A * 6/1985 McKenna ..... B63B 1/125
114/39.27
5,136,961 A * 8/1992 Follett ..... B63B 1/248
114/274
7,234,404 B2 * 6/2007 Tissier ..... B63H 9/10
114/39.26
8,695,520 B1 * 4/2014 Berte' ..... B63B 1/14
114/39.27
10,377,447 B2 * 8/2019 Steinkogler ..... B63B 13/00

* cited by examiner

SAILING VESSEL

CROSS-REFERENCE TO RELATED APPLICATIONS

This application claims the benefit of and priority to French Application No. 1901592, filed on Feb. 16, 2019, the disclosure of which is hereby incorporated by reference in its entirety.

TECHNICAL FIELD

The present disclosure relates generally to a sailing vessel that is substantially free of heeling during navigation.

BACKGROUND

Traditional sailboats use the deflection of the sail in relation to the longitudinal axis of the sailboat to navigate in various directions. The piloting of the traditional boats is well represented by the image of the skipper, eyes fixed on the horizon and hands on the bar. To sail efficiently, it is important to maintain an optimal angle with respect to the wind direction and limit the extent of heeling. Heeling can occur when the sail is subject to wind pressure. Under heavy wind conditions, the skipper must orient the sail according to the fluctuations of the wind and limit the extent of heeling, sometimes continuously. To limit the extent of heeling, various devices including ballasts, deep keels, crew displacement, loads, foils, and/or lateral floats can be used. These devices can be heavy, costly, and have limited efficiency. Excessive heeling can lead to capsizing, which can be dangerous and sometimes fatal.

SUMMARY

One aspect of the present disclosure relates to a sailing vessel comprising the following components: (a) a first end portion that comprises: a sail having a first edge and a second edge that define a plane of the sail, the first edge having a first end and a second end, wherein the sailing vessel is characterized by a longitudinal axis perpendicular or substantially perpendicular to the first edge; a first float coupled to the first end of the first edge; and a second float coupled to the second end of the first edge, wherein the first float and the second float are configured to provide buoyancy to the sailing vessel; (b) a first line coupled to the first end of the first edge; (c) a second line coupled to the second end of the first edge; (d) a second end portion that comprises: a cockpit; a rudder; a tiller coupled to the rudder and configured to rotate the rudder to change the heading of the sailing vessel; a third float configured to provide buoyancy to the sailing vessel; and a sail-control system including: a pulley coupled to the first line and the second line; and a handle coupled to the pulley and configured to rotate the pulley to adjust a length of the first line relative to a length of the second line, thereby adjusting the angle between the first edge of the sail and the longitudinal axis; and (e) a mast arranged in between the first end portion and the second end portion and configured to keep the sail raised through coupling with the second edge.

In some embodiments, during navigation, the wind exerts an aerodynamic force on the sail, and water exerts a hydrodynamic force on the third float, the aerodynamic force and the hydrodynamic force being parallel or substantially parallel to the longitudinal axis.

In some embodiments, during navigation, the longitudinal axis is perpendicular or substantially perpendicular to the apparent wind direction.

In some embodiments, the handle is turned anti-clockwise to sail on a port tack, or turned clockwise to sail on a starboard tack.

In some embodiments, the handle is a lever.

In some embodiments, the sail-control system further comprises a worm drive that includes a worm screw and a worm wheel coupled to the worm screw via threads, the worm screw configured to be driven by the handle to rotate the worm wheel coupled to the pulley, thereby adjusting the length of the first line relative to the length of the second line.

In some embodiments, the sailing vessel further comprises a first sheet track traveler disposed on the first float and configured to permit movement of the first line thereon.

In some embodiments, the sailing vessel further comprises a second sheet track traveler disposed on the second float and configured to permit movement of the second line thereon.

In some embodiments, the first sheet track traveler comprises a first booster spring.

In some embodiments, the second sheet track traveler comprises a second booster spring.

In some embodiments, the sailing vessel further comprises a first foil coupled to the first float and configured to reduce hydrodynamic drag of the sailing vessel. In some embodiments, the first foil is configured to rotate along an axis in a water current. In some embodiments, the first foil comprises an aileron.

In some embodiments, the sailing vessel further comprises a second foil coupled to the second float and configured to reduce hydrodynamic drag of the sailing vessel. In some embodiments, the second foil is configured to rotate along an axis in a water current. In some embodiments, the second foil comprises an aileron.

In some embodiments, the first line and the second line are joined together as one continuous line.

In some embodiments, the sailing vessel further comprises a third foil coupled to the rudder and configured to reduce hydrodynamic drag of the sailing vessel.

In some embodiments, the sailing vessel further comprises a second worm drive that includes a second worm screw and a second worm wheel coupled to the second worm screw via threads, the second worm screw is configured to be driven by the tiller to rotate the second worm wheel.

In some embodiments, the tiller is positioned in the cockpit.

In some embodiments, the sail-control system is positioned in the cockpit.

In some embodiments, the sail is symmetric.

In some embodiments, the sail is asymmetric.

In some embodiments, the sailing vessel further comprises a second pulley disposed on the first pulley and configured to control the deviation of the second edge.

DETAILED DESCRIPTION

Embodiments described herein relate to a sailing vessel that can balance the aerodynamic force and hydrodynamic force exerted on the vessel. As a result, the issue of heeling is substantially obviated in the sailing vessel of the present disclosure.

Figure 1:
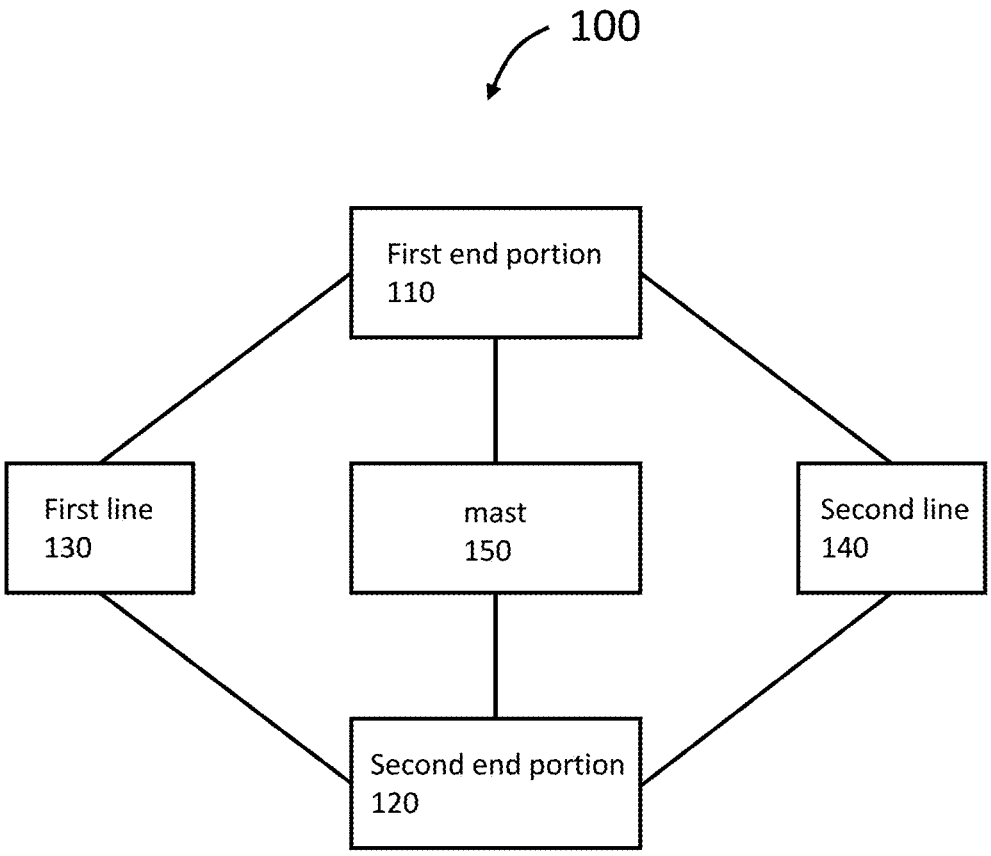
FIG. 1 is a diagram of a sailing vessel, in accordance with some embodiments.

FIG. 1 shows a schematic illustration of a sailing vessel 100, according to an embodiment. The sailing vessel 100 includes a first end portion 110 coupled to a second end portion 120; a first line 130 and a second line 140, each of which can be coupled to the first end portion 110 and the second end portion 120; and a mast 150 arranged in between the first end portion 110 and the second end portion 120. The bow of the sailing vessel 100 can include the first end portion 110, while the stern of the sailing vessel 100 can include the second end portion 120.

In some embodiments, the first end portion 110 can include a sail having a first edge and a second edge, which define a plane of the sail. The first edge can have a first end and a second end. The sailing vessel can be characterized by a longitudinal axis perpendicular or substantially perpendicular to the first edge.

In some embodiments, the first end portion 110 can include a first float coupled to the first end of the first edge, and/or a second float coupled to the second end of the first edge. The first float and/or the second float are configured to provide buoyancy to the sailing vessel.

In some embodiments, the second end portion 120 can include a cockpit, a rudder, a tiller, a third float, and/or a sail-control system. In some embodiments, the sail-control system can include a pulley and a handle coupled to the pulley. The cockpit can be configured to provide space for one or more sailor to sit. The rudder and the tiller can be configured to allow a sailor to steer the sailing vessel 100. The third float can be configured to provide buoyancy to the sailing vessel 100. The sail-control system can be configured to adjust the angle between the first edge of the sail and the longitudinal axis for sailing on different tacks.

The first end portion 110 can be coupled to the second end portion 120 through the first line 130 and/or the second line 140. In some embodiments, the first line 130 can be coupled to the first end of the first edge and the pulley in the sail-control system. In some embodiments, the second line 140 can be coupled to the second end of the first edge and the pulley in the sail-control system. Through these coupling mechanisms, when the handle rotates the pulley, a length of the first line 130 relative to a length of the second line 140 can be adjusted, thereby adjusting the angle between the first edge of the sail and the longitudinal axis.

In some embodiments, the sailing vessel 100 can further include one or more structural elements positioned in between the first end portion 110 and the second end portion 120, such that the first end portion 110 can be coupled to the second end portion 120 through the one or more structural elements. The mast 150 can also be positioned between the first end portion 110 and the second end portion 120. The second edge of the sail can be coupled to the mast 150, thereby keeping the sail raised.

Figure 2:
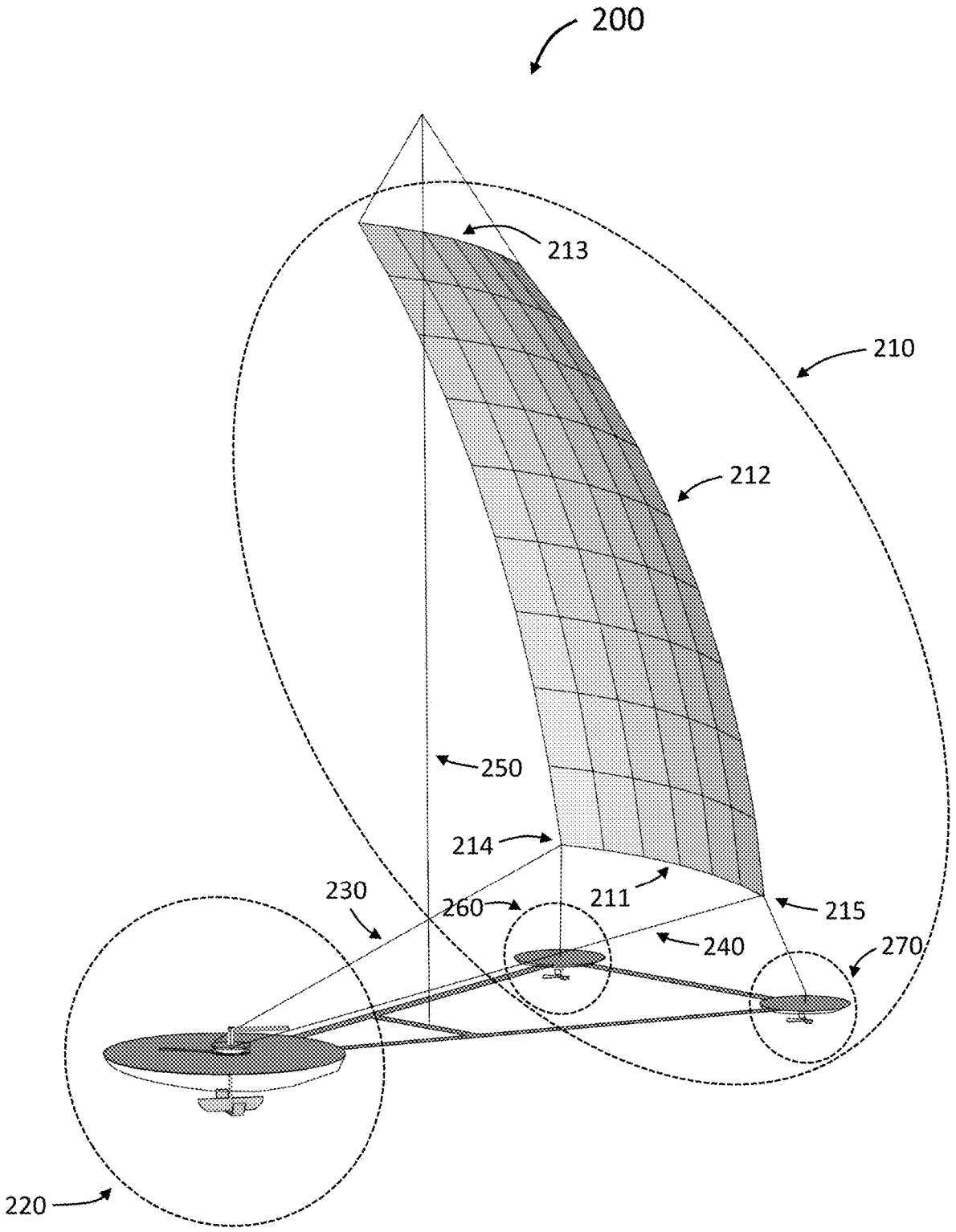
FIG. 2 is a schematic diagram of a sailing vessel, in accordance with some embodiments.

A related aspect of the present disclosure relates a sailing vessel 200 having a first end portion 210 coupled to a second end portion 220; a first line 230 and a second line 240, each of which can be coupled to the first end portion 210 and the second end portion 220; and a mast 250 arranged in between the first end portion 210 and the second end portion 220, as shown in FIG. 2 in accordance with some embodiments. The bow of the sailing vessel 200 can include the first end portion 210, while the stern of the sailing vessel 200 can include the second end portion 220.

The first end portion 210 can include a sail 212, a first float portion 260, and a second float portion 270. The sail 212 can have a first edge 211 and a second edge 213. The first edge 211 and the second edge 213 can define a plane of the sail 212. The first edge 211 can have a first end 214 and a second end 215. The sailing vessel 200 can be characterized by a longitudinal axis perpendicular or substantially perpendicular to the first edge 211 of the sail 212.

Figure 3:
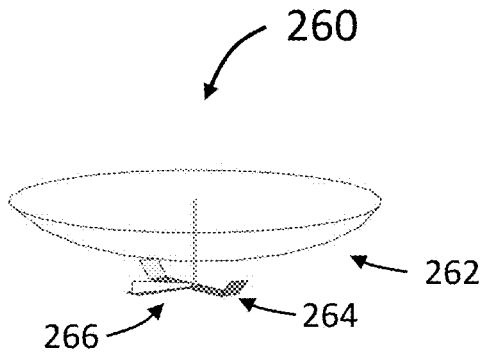
FIG. 3 is a schematic diagram of a first float portion of the sailing vessel of FIG. 2, in accordance with some embodiments.

The first float portion 260 can include a first float 262, as shown in FIG. 3 in accordance with some embodiments. In some embodiments, the first float portion 260 can further include a first foil 264 and a first aileron 266. The first foil 264 can be coupled to the first float 262 and configured to reduce the hydrodynamic drag of the sailing vessel 200. The first foil 264 can help lift the sailing vessel 200 when the vessel speed exceeds a certain threshold, e.g., between about 8 knots and 10 knots. In some embodiments, the threshold is about 8 knots, about 8.5 knots, about 9 knots, about 9.5 knots, or about 10 knots. In some embodiments, the first foil 264 can rotate freely along an axis in a water current. The first aileron 266 can be coupled to the first foil 264. The first aileron 266 can help the first foil 264 orient itself according to the current.

Figure 4:
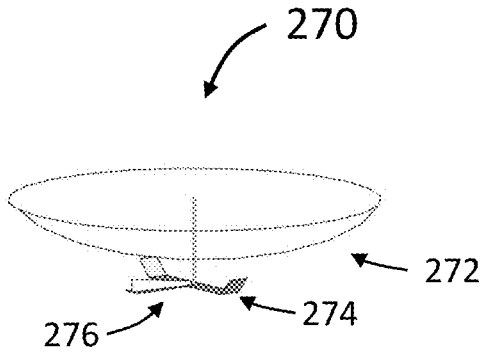
FIG. 4 is a schematic diagram of a second float portion of the sailing vessel of FIG. 2, in accordance with some embodiments.

The second float portion 270 can include a second float 272, as shown in FIG. 4 in accordance with some embodiments. In some embodiments, the second float portion 270 can further include a second foil 274 and a second aileron 276. The second foil 274 can be coupled to the second float 272 and configured to reduce the hydrodynamic drag of the sailing vessel 200. The second foil 274 can help lift the sailing vessel 200 when the vessel speed exceeds a certain threshold, e.g., between about 8 knots and 10 knots. In some embodiments, the threshold is about 8 knots, about 8.5 knots, about 9 knots, about 9.5 knots, or about 10 knots. In some embodiments, the second foil 274 can rotate freely along an axis in a water current. The second aileron 276 can be coupled to the second foil 274. The second aileron 276 can help the second foil 274 orient itself according to the current.

Figure 5:
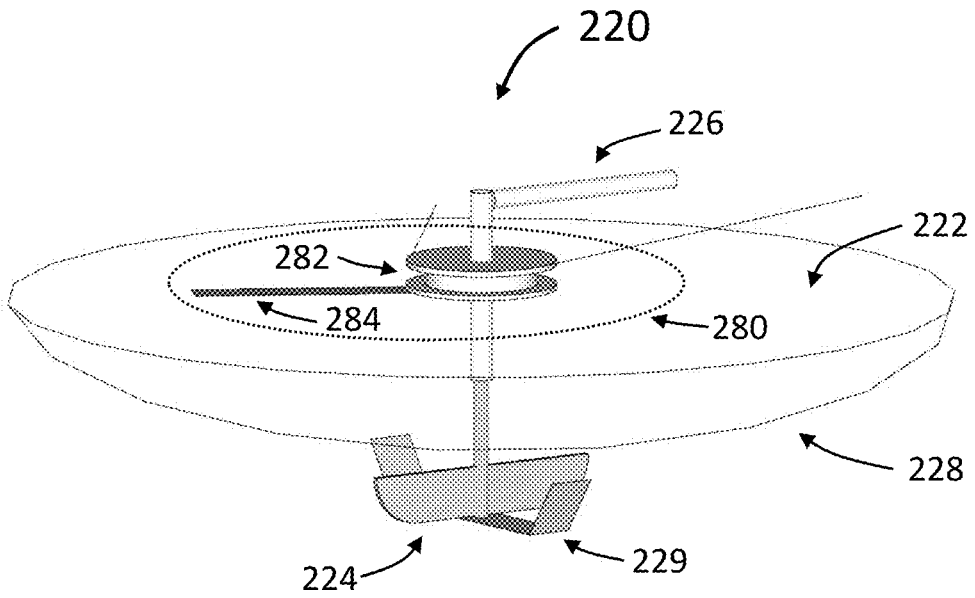
FIG. 5 is a schematic diagram of a second end portion of the sailing vessel of FIG. 2, in accordance with some embodiments.

The second end portion 220 can include a cockpit 222, a rudder 224, a tiller 226, a third float 228, and a sail-control system 280, as shown in FIG. 5 in accordance with some embodiments. The sail-control system 280 can include a pulley 282 and a handle 284 coupled to the pulley 282. In some embodiments, the handle is a lever. The tiller 226 can be coupled to the rudder 224, such that movement (e.g., rotation) of the tiller 226 can move (e.g., rotate) the rudder 224, thereby changing the direction of the sailing vessel 200. The second end portion 220 can further include a third foil 229. The third foil 229 can be coupled to the rudder 224 and configured to reduce the hydrodynamic drag of the sailing vessel 200. The third foil 229 can help lift the sailing vessel 200 when the vessel speed exceeds a certain threshold, e.g., between about 8 knots and 10 knots. In some embodiments, the threshold is about 8 knots, about 8.5 knots, about 9 knots, about 9.5 knots, or about 10 knots.

The tiller 226 can be positioned in the cockpit 222. The sail-control system 280 can be positioned in the cockpit 222. The cockpit 222 can be configured to provide space for one or more sailor to sit. The rudder 224 and the tiller 226 can be configured to provide means for a sailor to steer the sailing vessel 200. The third float 228 can be configured to provide buoyancy to the sailing vessel 200. The sail-control system 280 can be configured to adjust the angle between the first edge 211 of the sail 212 and the longitudinal axis.

The first line 230 can be on the left-hand side (i.e., port) of the sailing vessel 200. The first line 230 can be coupled to the first end 214 and the pulley 282. The second line 240 can be on the right-hand side (i.e., starboard) of the sailing vessel 200. The second line 240 can be coupled to the second end 215 and the pulley 282. In some embodiments, the first line 230 and the second line 240 can be joined together as one continuous line.

Figure 6A:
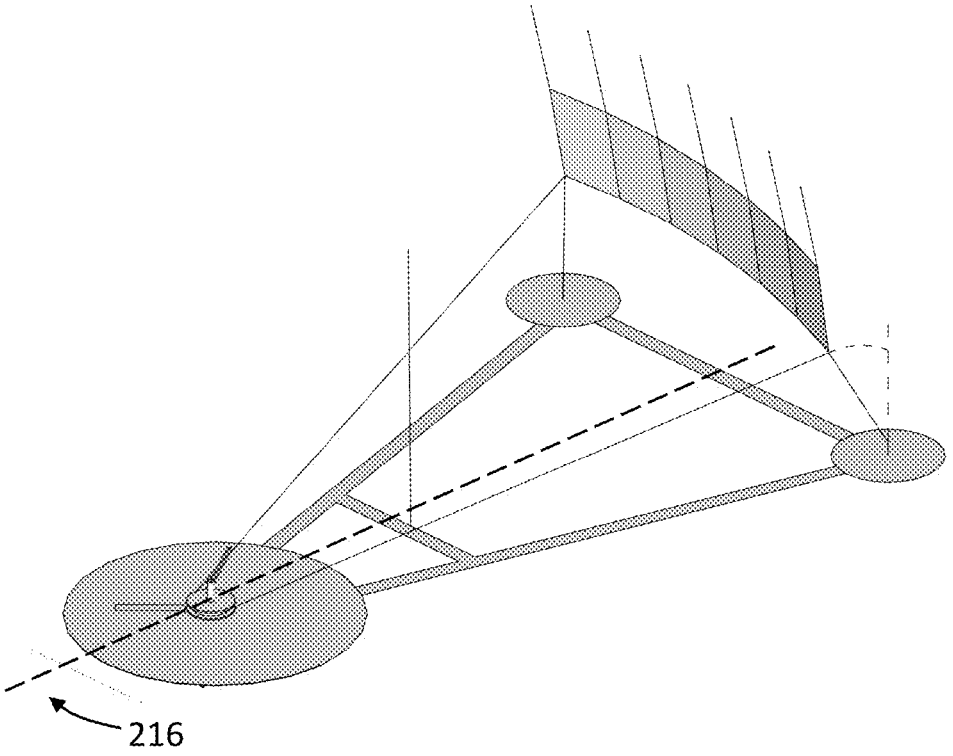
FIG. 6A is a schematic diagram of a mechanism for manipulating the sail of the sailing vessel of FIG. 2 during navigation, in accordance with some embodiments.

The first line 230 and the second line 240 can control the angle between the first edge 211 of the sail 212 and the longitudinal axis of the sailing vessel 200. When a movement of the handle 284 rotates the pulley 282, the length of the first line 230 relative to the length of the second line 240 can be adjusted. The sail 212 pivots as a result of the line adjustment around the point where the sail 212 is coupled to the mast 250. For example, as shown in FIG. 6A, the longitudinal axis 216 remains the same during navigation and when the length of the first line 230 and the length of the second line 240 are substantially the same, the angle between the first edge 211 of the sail 212 and the longitudinal axis 216 is about 90°. By shortening the length of the second line 240, the angle becomes greater than 90°. In some embodiments, the handle 284 is turned anti-clockwise to sail on a port tack, or turned clockwise to sail on a starboard tack. In some embodiments, to sail on a port tack, the first line 230 is shorter than the second line 240; to sail on a starboard tack, the first line 230 is longer than the second line 240.

The angle between the first edge 211 of the sail 212 and the longitudinal axis 216 is labeled as α. For example, see FIGS. 6B and 6C. The first edge 211 can be approximated by a straight line connecting the first end and second end of the first edge. In some embodiments, α can be at least about 80°, at least about 81°, at least about 82°, at least about 83°, at least about 84°, at least about 85°, or greater than about 90°. In some embodiments, α can be no more than about 100°, no more than about 99°, no more than about 98°, no more than about 97°, no more than about 96°, no more than about 95°, or less than about 90°.

Combinations of the above-referenced ranges for α are also possible. For example, α can be in the range of about 80° to about 100°, or about 85° to about 95°.

Figure 6B:
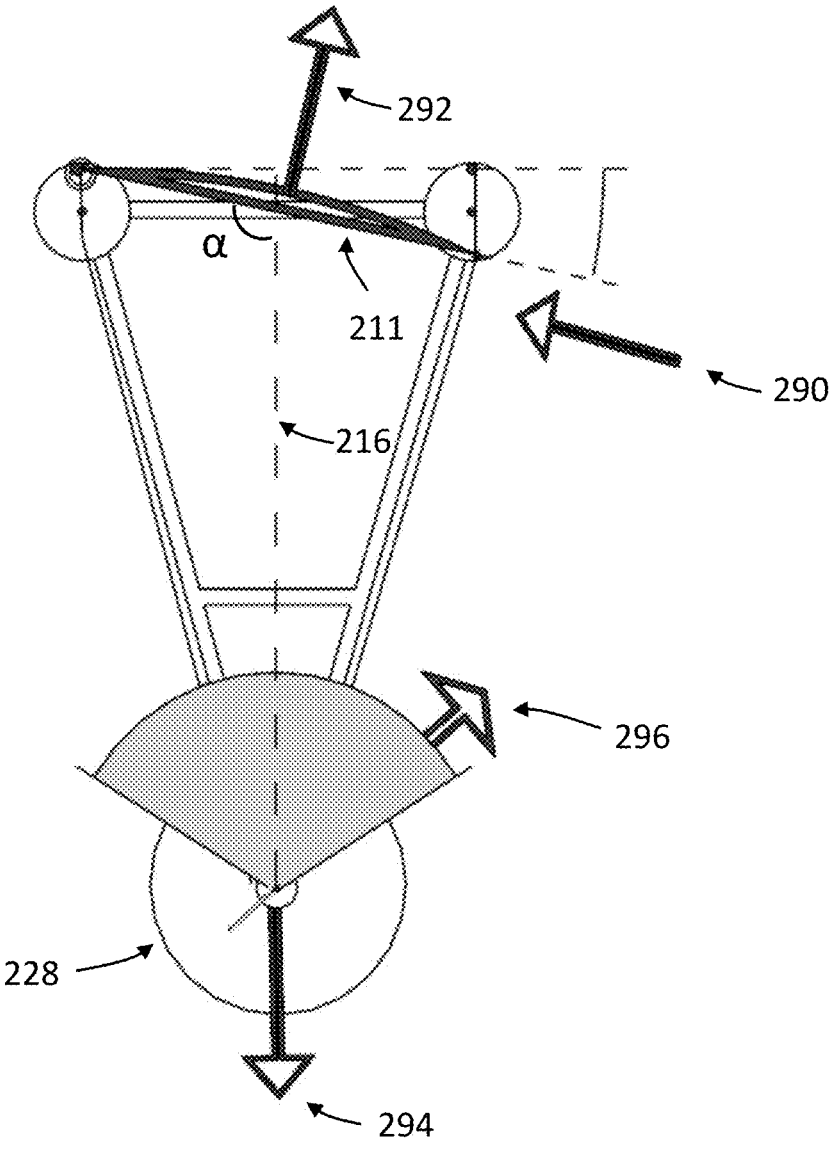
FIG. 6B is a schematic diagram of a top-down view of the sailing vessel shown in FIG. 6A when it is on a starboard tack. The shaded cone illustrates the range of angle for the direction 296.

FIG. 6B is a schematic diagram showing a top-down view of the sailing vessel 200 as shown in FIG. 6A when it is on a starboard tack. In some embodiments where the sailing vessel 200 is sailing on a starboard tack, α can be greater than about 90°, e.g., about 91° to about 100°, or about 95°.

Figure 6C:
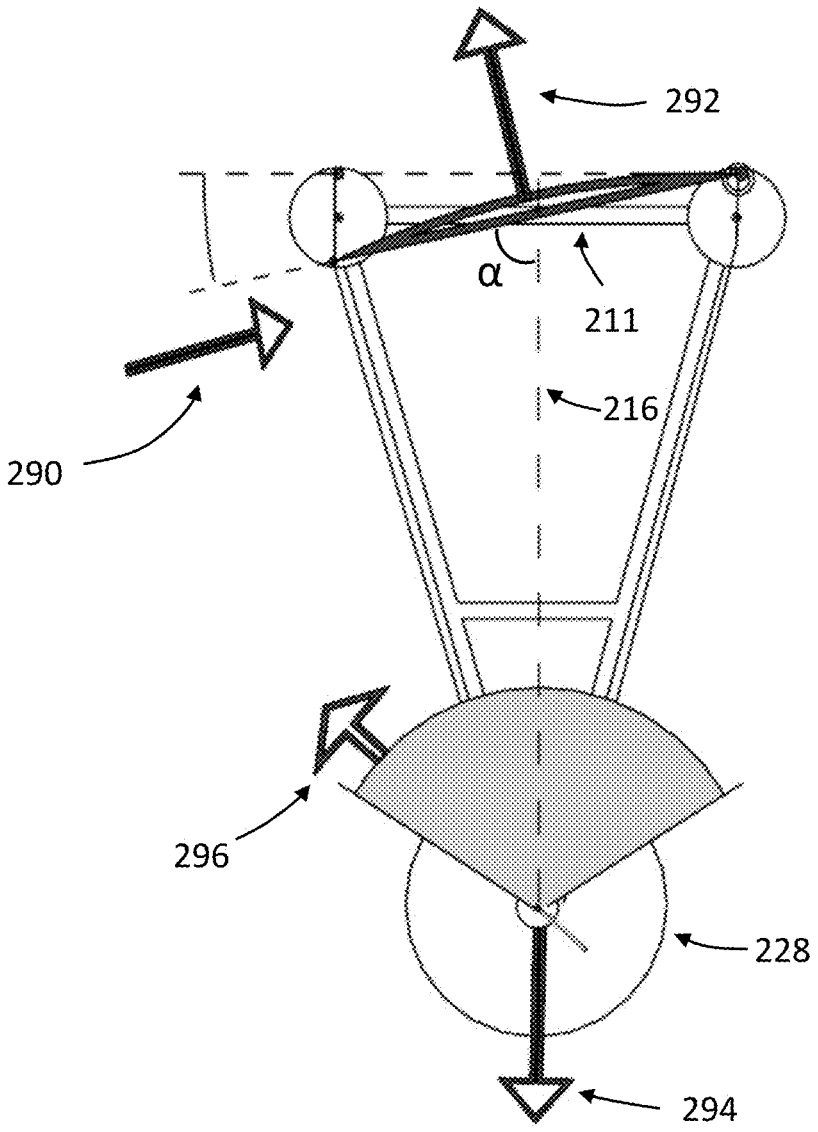
FIG. 6C is a schematic diagram showing a top-down view of the sailing vessel 200 as shown in FIG. 6A when it is on a port tack. The shaded cone illustrates the range of angle for the direction 296.

FIG. 6C is a schematic diagram showing a top-down view of the sailing vessel 200 as shown in FIG. 6A when it is on a port tack. In some embodiments where the sailing vessel 200 is sailing on a port tack, α can be less than about 90°, e.g., about 89° to about 80°, or about 85°.

During navigation, the wind 290 exerts an aerodynamic force 292 on the sail 212, and water exerts a hydrodynamic force 294 on the third float 228, the aerodynamic force 292 and the hydrodynamic force 294 being parallel or substantially parallel to the longitudinal axis 216. In some embodiments, the sailing vessel 200 moves at the direction 296. The longitudinal axis 216 is perpendicular or substantially perpendicular to the apparent wind direction 290. As the wind 290 comes from the right-hand side of the sailing vessel 200, the sailing vessel 200 is considered to be sailing on a starboard tack in FIG. 6B. As the wind 290 comes from the left-hand side of the sailing vessel 200, the sailing vessel 200 is considered to be sailing on a port tack in FIG. 6C.

In some embodiments, the sail-control system 280 can further include a worm drive that includes a worm screw (i.e., endless screw) and a worm wheel. The worm screw can be coupled to the worm wheel via thread and the handle 284. The worm wheel can be coupled to the pulley 282. The worm screw can be configured to be driven by the handle 284 to rotate the worm wheel, which in turn rotates the pulley 282, thereby adjusting the length of the first line 230 relative to the length of the second line 240. The worm wheel and the pulley 282 can have the same rotational axis.

In some embodiments, the sail-control system 280 can further include a worm screw coupled to the pulley 282 via threads and the handle 284. The worm screw can be configured to be driven by the handle 284 to rotate the pulley 282, thereby adjusting the length of the first line 230 relative to the length of the second line 240.

The mast 250 can be arranged in between the first end portion 210 and the second end portion 220. The mast 250 can be coupled to the second edge 213, thereby keeping the sail 212 raised. In some embodiments, the sail 212 can be tilted backwards towards the second end portion 220 to generate an upward aerodynamic force, which can reduce the drag in the water. In some embodiments, the sail 212 is symmetric. In some embodiments, the sail 212 is asymmetric.

In some embodiments, the sailing vessel 200 can further include one or more structural elements positioned in between the first end portion 210 and the second end portion 220, such that the first end portion 210 can be coupled to the second end portion 220 through the one or more structural elements. The one or more structural elements can provide stability to the sailing vessel 200.

In some embodiments, the sailing vessel 200 can further include a second worm drive coupled to the rudder 224 and the tiller 226. The second worm drive can include a second worm screw and a second worm wheel coupled to the second worm screw via threads. The second worm screw is configured to be driven by the tiller 226 to rotate the second worm wheel, which in turn rotates the rudder 224 to change the direction of the sailing vessel 200.

In some embodiments, the sailing vessel 200 can further include a second pulley disposed on the first pulley and configured to adjust the deviation of the second edge 213 of the sail 212. The second pulley can be coupled to the each end of the second edge 213 through a line. A worm drive can be used for adjusting the deviation.

Figure 7A:
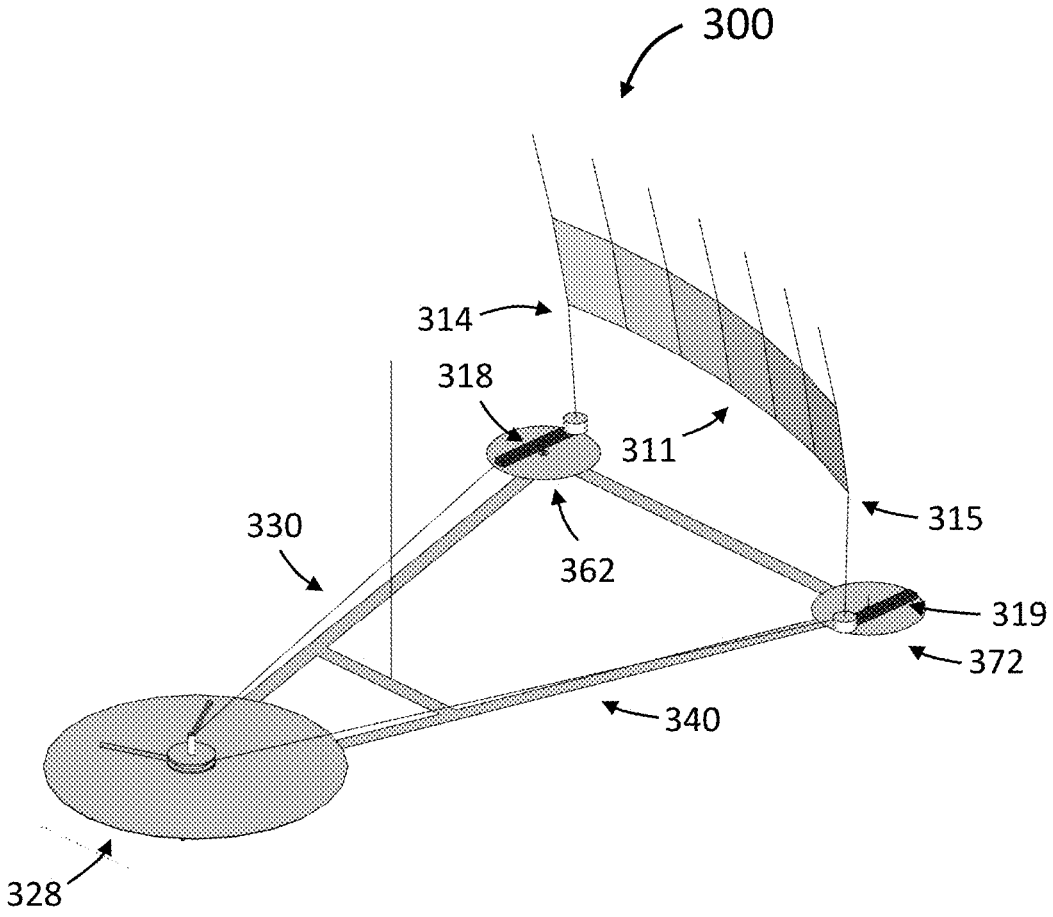
FIG. 7A is a schematic diagram of a mechanism for manipulating the sail of a sailing vessel during navigation, in accordance with some embodiments.

FIG. 7A is a schematic diagram showing the mechanism for manipulating the sail of a sailing vessel 300 during navigation in accordance with some embodiments. The sailing vessel 300 can include a first sheet traveler 318 and a second sheet traveler 319. The first sheet traveler 318 can be disposed on the first float 362 and configured to permit movement of the first line 330 disposed thereon. Movement of the first line 330 can move the first end 314 of the first edge 311. The second sheet traveler 319 can be disposed on the second float 372 and configured to permit movement of the second line 340 disposed thereon. Movement of the second line 340 can move the second end 315 of the first edge 311. For example, by pulling the first line 330 towards the third float 328, the first end 314 can be pulled closer to the third float 328, and the second end 315 can move further away from the third float 328. Similarly, by pulling the second line 340 towards the third float, the second end 315 can be pulled closer to the third float 328, and the first end 314 can move further away from the third float 328. As a result, the first sheet traveler 318 and the second sheet traveler 319 permit adjusting the angle between the first edge 311 of the sail and the longitudinal axis.

In some embodiments, the first sheet traveler 318 can include a first booster spring. In some embodiments, the second sheet traveler 319 can include a second booster spring. The booster springs can be configured to bring the first edge 311 back to its neutral position (i.e., being perpendicular to the longitudinal axis) when the first and second lines 330, 340 are not being pulled.

The angle between the first edge 311 of the sail 312 and the longitudinal axis 316 is labeled as β. For example, see FIGS. 7B and 7C. The first edge 311 can be approximated by a straight line connecting the first end and second end of the first edge. In some embodiments, β can be at least about 80°, at least about 81°, at least about 82°, at least about 83°, at least about 84°, at least about 85°, or greater than about 90°. In some embodiments, β can be no more than about 100°, no more than about 99°, no more than about 98°, no more than about 97°, no more than about 96°, no more than about 95°, or less than about 90°.

Combinations of the above-referenced ranges for β are also possible. For example, β can be in the range of about 80° to about 100°, or about 85° to about 95°.

Figure 7B:
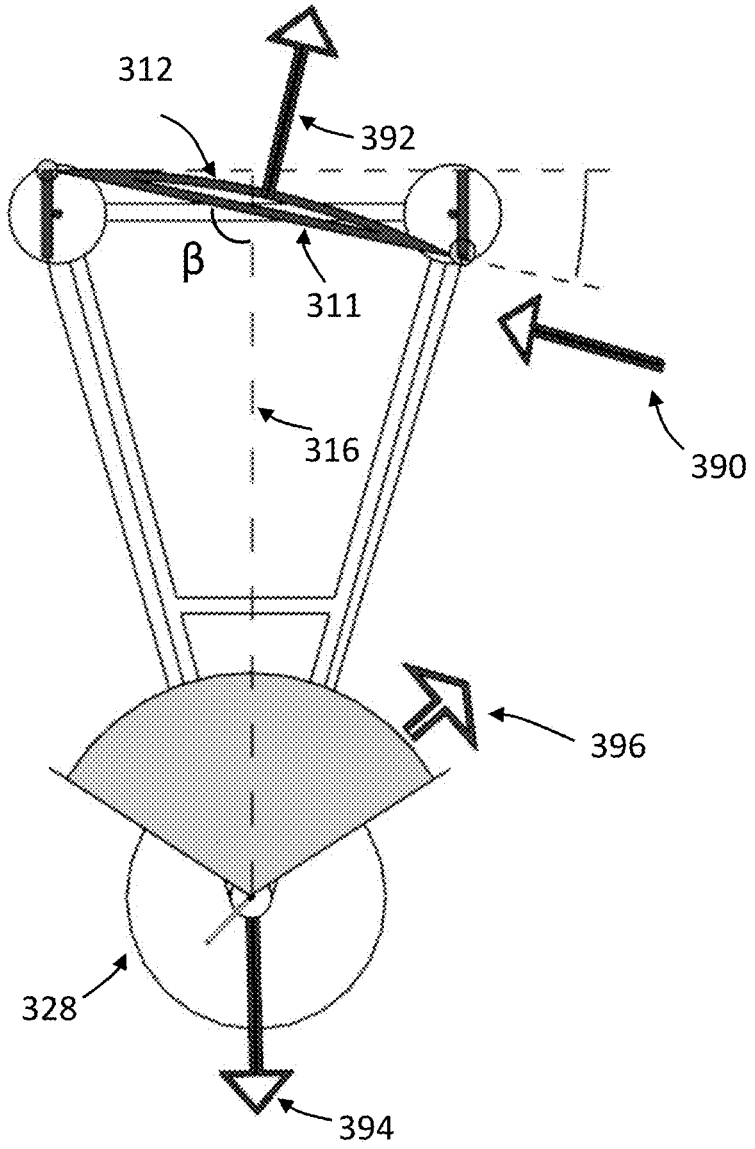
FIG. 7B is a schematic diagram of a top-down view of the sailing vessel shown in FIG. 7A when it is on a starboard tack. The shaded cone illustrates the range of angle for the direction 396.

FIG. 7B is a schematic diagram showing a top-down view of the sailing vessel 300 as shown in FIG. 7A when it is on a starboard tack. In some embodiments where the sailing vessel 300 is sailing on a starboard tack, β can be greater than about 90°, e.g., bout 91° to about 100°, or about 95°.

Figure 7C:
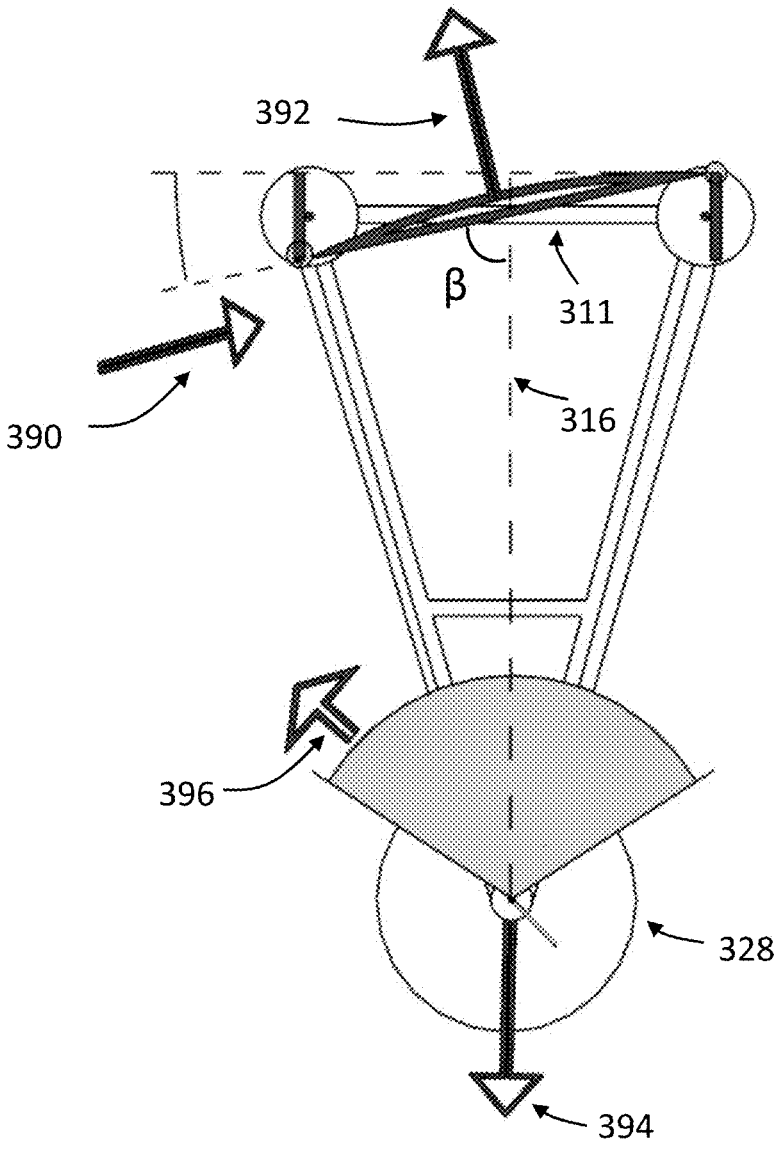
FIG. 7C is a schematic diagram of a top-down view of the sailing vessel shown in FIG. 7A when it is on a port tack. The shaded cone illustrates the range of angle for the direction 396.

FIG. 7C is a schematic diagram showing a top-down view of substantially the same sailing vessel 300 as shown in FIG. 7A when it is on a port tack. In some embodiments where the sailing vessel 300 is sailing on a port tack, β can be less than about 90°, e.g., about 89° to about 80°, or about 85°.

During navigation, the wind 390 exerts an aerodynamic force 392 on the sail 312, and water exerts a hydrodynamic force 394 on the third float 328, the aerodynamic force 392 and the hydrodynamic force 394 being parallel or substantially parallel to the longitudinal axis 316. In some embodiments, the sailing vessel 300 moves at the direction 396. The longitudinal axis 316 is perpendicular or substantially perpendicular to the apparent wind direction 390. As the wind 390 comes from the right-hand side of the sailing vessel 300, the sailing vessel 300 is considered to be sailing on a starboard tack in FIG. 7B. As the wind 390 comes from the left-hand side of the sailing vessel 300, the sailing vessel 300 is considered to be sailing on a port tack in FIG. 7C.

Figure 8A:
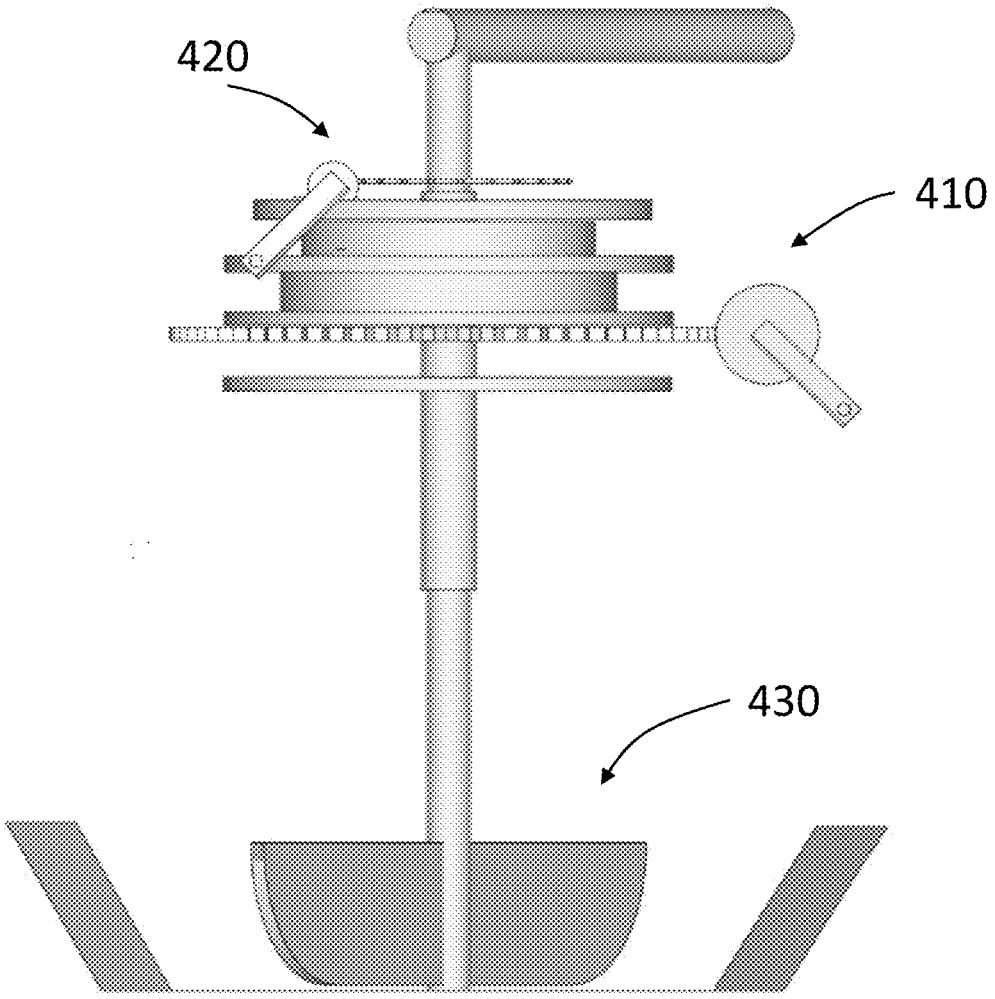
FIG. 8A is a schematic diagram of two worm drives on a sailing vessel, in accordance with some embodiments.
Figure 8B:
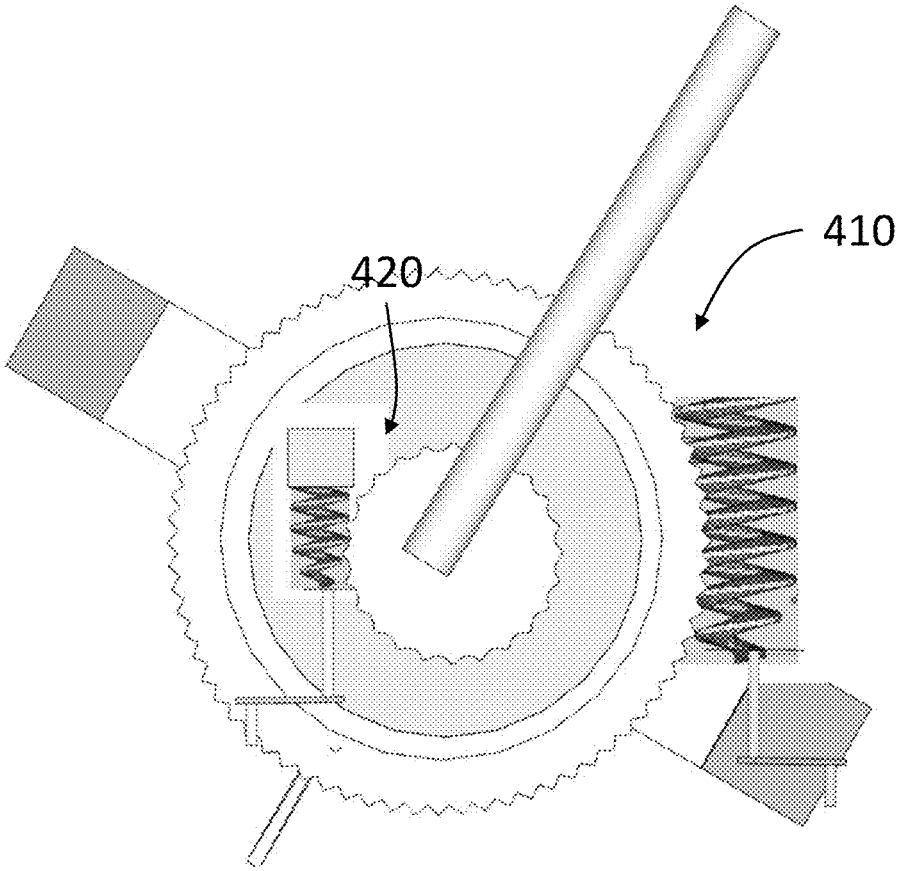
FIG. 8B is a top-down view of the worm drives shown in FIG. 8A.

FIG. 8A is a schematic diagram of two worm drives on a sailing vessel, in accordance with some embodiments. A first worm drive 410 is part of the sail-control system and can be used to adjust the length of the first line relative to the length of the second line, thereby adjusting the angle of the sail with respect to the wind direction. A second worm drive 420 can be used to rotate the rudder 430.

Figure 9:
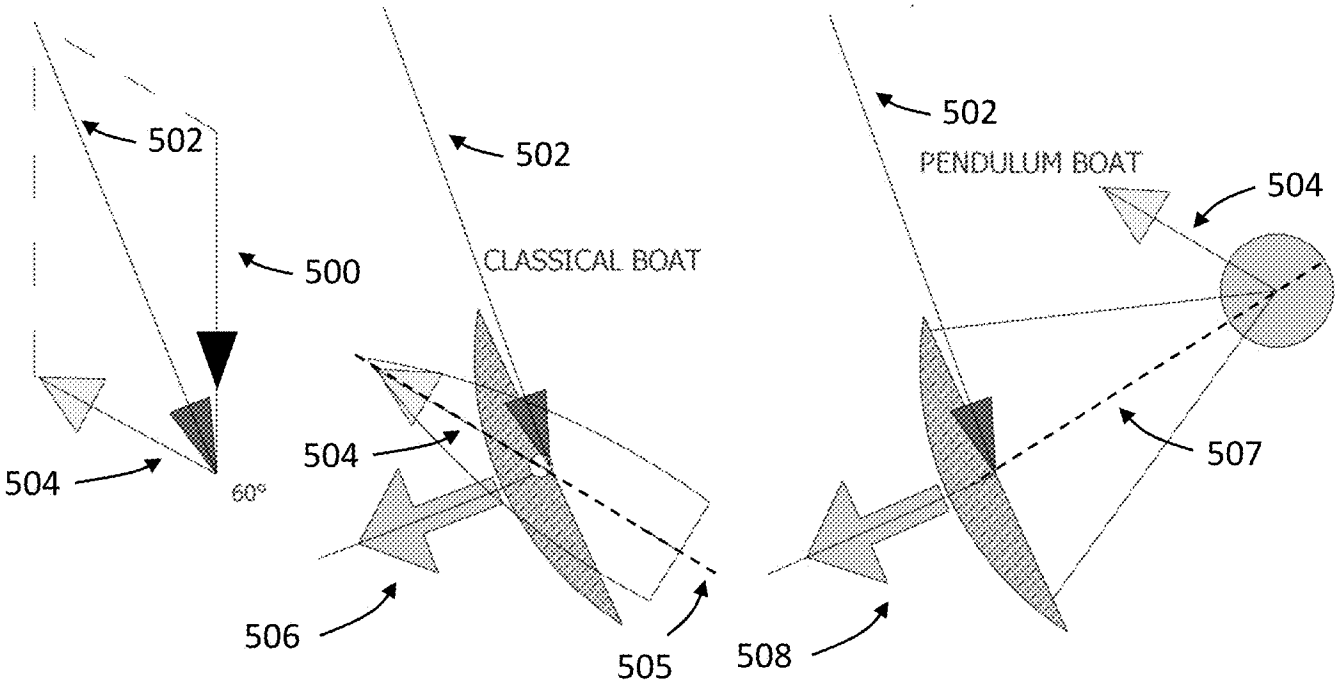
FIG. 9 is a schematic diagram showing the differences between a classical sailboat and the sailing vessel of the present disclosure ("Pendulum Boat") during navigation, in accordance with some embodiments.

FIG. 9 is a schematic diagram showing the operational differences between a classical sailboat and the sailing vessel of the present disclosure ("Pendulum Boat") during navigation. As shown in the left panel of FIG. 9, the combination of the true wind direction 500 and a sailboat direction 504 results in an apparent wind direction 502. The apparent wind direction 502 exerts a force on the classical sailboat or the Pendulum Boat.

As shown in the middle panel of FIG. 9, for a classical sailboat having a longitudinal axis 505, it can have the following characteristics during navigation: (a) the sailboat direction 504 is parallel or substantially parallel to the longitudinal axis 505; (b) as the wind exerts an aerodynamic force 506 on the sail, there is an angle between the aerodynamic force 506 and the longitudinal axis 505.

In contrast, as shown in the right panel of FIG. 9, for the Pendulum Boat having a longitudinal axis 507, it can have the following characteristics during navigation: (a) the aerodynamic force 508 exerted on the sail is parallel or substantially parallel to the longitudinal axis 507; (b) the longitudinal axis 507 is perpendicular or substantially perpendicular to the apparent wind direction 502; and (c) there is an angle between the sailboat direction 504 and the longitudinal axis 507. As a result, the Pendulum Boat moves laterally to the chosen destination. The Pendulum Boat moves in the direction 504 set by the skipper, typically between about 30 and about 150 degrees or between about 40 and 140 degrees in relation to the apparent wind direction 502 when sailing on a starboard tack, or between about −30 and −150 degrees or between −40 and −140 degrees in relation to the apparent wind direction 502 when sailing on a port tack.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." Any ranges cited herein are inclusive.

The terms "substantially", "approximately," and "about" used throughout this Specification and the claims generally mean plus or minus 10% of the value stated, e.g., about 100 would include 90 to 110.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A sailing vessel comprising:

a first end portion that comprises:

a sail having a first edge and a second edge that define a plane of the sail, the first edge having a first end and a second end, wherein the sailing vessel is characterized by a longitudinal axis perpendicular or substantially perpendicular to the first edge;

a first float coupled to the first end of the first edge; and a second float coupled to the second end of the first edge, wherein the first float and the second float are configured to provide buoyancy to the sailing vessel;

a first line coupled to the first end of the first edge;

a second line coupled to the second end of the first edge;

a second end portion that comprises:

a cockpit;

a rudder;

a tiller coupled to the rudder and configured to rotate the rudder to change a heading of the sailing vessel;

a third float configured to provide buoyancy to the sailing vessel; and a sail-control system including:

a pulley coupled to the first line and the second line; and a handle coupled to the pulley and configured to rotate the pulley to adjust a length of the first line relative to a length of the second line, thereby adjusting an angle between the first edge of the sail and the longitudinal axis; and a mast arranged in between the first end portion and the second end portion and configured to keep the sail raised through coupling with the second edge.

2. The sailing vessel of claim 1, wherein during navigation, the wind exerts an aerodynamic force on the sail, and water exerts a hydrodynamic force on the third float, the aerodynamic force and the hydrodynamic force being parallel or substantially parallel to the longitudinal axis.

3. The sailing vessel of claim 1, wherein during navigation, the longitudinal axis is perpendicular or substantially perpendicular to an apparent wind direction.

4. The sailing vessel of claim 1, wherein the handle is turned anti-clockwise to sail on a port tack, or turned clockwise to sail on a starboard tack.

5. The sailing vessel of claim 1, wherein the handle is a lever.

6. The sailing vessel of claim 1, wherein the sail-control system further comprises:

a worm drive that includes a worm screw and a worm wheel coupled to the worm screw via threads, the worm screw configured to be driven by the handle to rotate the worm wheel coupled to the pulley, thereby adjusting the length of the first line relative to the length of the second line.

7. The sailing vessel of claim 1, further comprising:

a first sheet traveler disposed on the first float and configured to permit movement of the first line thereon.

8. The sailing vessel of claim 1, further comprising:

a second sheet traveler disposed on the second float and configured to permit movement of the second line thereon.

9. The sailing vessel of claim 7, wherein the first sheet traveler comprises a first booster spring.

10. The sailing vessel of claim 8, wherein the second sheet traveler comprises a second booster spring.

11. The sailing vessel of claim 1, further comprising:

a first foil coupled to the first float and configured to reduce hydrodynamic drag of the sailing vessel.

12. The sailing vessel of claim 11, wherein the first foil is configured to rotate along an axis in a water current.

13. The sailing vessel of claim 11, wherein the first foil comprises an aileron.

14. The sailing vessel of claim 1, further comprising:

a second foil coupled to the second float and configured to reduce hydrodynamic drag of the sailing vessel.

15. The sailing vessel of claim 14, wherein the second foil is configured to rotate along an axis in a water current.

16. The sailing vessel of claim 14, wherein the second foil comprises an aileron.

17. The sailing vessel of claim 1, wherein the first line and the second line are joined together as one continuous line.

18. The sailing vessel of claim 1, further comprising:

a third foil coupled to the rudder and configured to reduce hydrodynamic drag of the sailing vessel.

19. The sailing vessel of claim 1, further comprising:

a second worm drive that includes a second worm screw and a second worm wheel coupled to the second worm screw via threads, the second worm screw is configured to be driven by the tiller to rotate the second worm wheel.

20. The sailing vessel of claim 1, further comprising a second pulley disposed on the first pulley and configured to control the deviation of the second edge.

* * * * *